US006747227B2

(12) United States Patent
Marmaropoulos et al.

(10) Patent No.: US 6,747,227 B2
(45) Date of Patent: Jun. 8, 2004

(54) SLIDING SWITCH

(75) Inventors: George Marmaropoulos, Yorktown Heights, NY (US); David A. Eves, Crawley (GB); Simon R. Turner, Redhill (GB); Asher J. Hoskins, Crawley (GB); Francis H. Geesin, Heathfield (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/392,294

(22) Filed: Mar. 19, 2003

(65) Prior Publication Data

US 2003/0230474 A1 Dec. 18, 2003

Related U.S. Application Data

(63) Continuation of application No. 09/790,343, filed on Feb. 21, 2001, now Pat. No. 6,596,955.

(30) Foreign Application Priority Data

Feb. 26, 2000 (GB) ..... 0004496

(51) Int. Cl.[7] ..... H01H 15/00
(52) U.S. Cl. ..... 200/550
(58) Field of Search ..... 200/549, 550, 200/2; 338/117

(56) References Cited

U.S. PATENT DOCUMENTS

| | | | | |
|---|---|---|---|---|
| 3,753,201 A | 8/1973 | Ohman | ..... | 338/92 |
| 4,603,327 A | 7/1986 | Leonard et al. | ..... | 340/573 |
| 5,798,907 A | 8/1998 | Janik | ..... | 361/683 |
| 5,912,653 A | 6/1999 | Fitch | ..... | 345/87 |

FOREIGN PATENT DOCUMENTS

| | | | |
|---|---|---|---|
| GB | 351392 | 6/1931 | |
| GB | 1248696 | 10/1971 | ..... H01H/25/54 |
| GB | 2307346 A | 5/1997 | ..... H01H/3/14 |

*Primary Examiner*—Anh Mai
*Assistant Examiner*—M. Fishman
(74) *Attorney, Agent, or Firm*—Gregory L. Thorne

(57) ABSTRACT

A sliding electrical switch (10) for use in a garment (32) has two spaced elongate flexible surfaces (16, 18), at least one electrical contact on each surface (22*a, b, c, d, e, f*), and a slider (20) slidable along the surfaces to cause electrical connection between the contacts. There may be a number of spaced contacts (22*a, b, c, d, e, f*), the slider (20) acting as a selector switch; or there may be two continuous spaced contacts (96, 98), movement of the slider (90) providing a variation in resistance. The slider can be a bead (20) running on cords (16, 18) attached to the edges of spaced pieces of fabric (14, 18); or a buckle (42) sliding on a strip (50); or a zip fastener traveller (66), adjacent teeth (64) of the zip being electrically connected (68); or a bead (90) running on lengths (82, 84) of flexible tubing with internally conductive strips (96, 98).

3 Claims, 7 Drawing Sheets

SLIDING SWITCH

This is a continuation of application Ser. No. 09/790,343 filed Feb. 21, 2001 now U.S. Pat. No. 6,596,955.

This invention relates to a sliding electrical switch or other control device for wearable electronics devices and systems, that is to say, for an electronic device configured such as to be incorporated into conventional clothing, and designed so as to be comfortable for the user to wear. This comfort may arise through the avoidance of flat, rigid surfaces, but preferably comes from the use, so far as possible, of flexible parts conformable to the human body.

Examples of wearable electronics are given in the commonly-assigned UK patent application number 9927842.6 filed Nov. 26, 1999 and entitled "Improved Fabric Antenna", and U.S. Pat. Nos. 5,798,907 and 5,912,653.

While sliding switches and/or controls are well known in electrical circuitry in many forms, such switches are not commonly used in wearing apparel, so such switches are not designed for compatibility with textiles or other garment fabrics, when considerable flexibility is required.

In U.S. Pat. No. 4,603,327 (Leonard et al) a zip fastener on a protective garment is provided with a pair of electrical contacts at one position along its length; opening of the zip causes a circuit to open, and a warning signal to be provided, but the arrangement provides only a simple open/closed indication.

In GB patent application number 2,307,346A (McGlone) a detector comprises a pair of spaced flexible strips down the back of a garment, the strip carrying pairs of contacts. If the wearer of the garment bends his back, the contacts are brought together and an alarm is sounded, but again the arrangement provides only a simple back bend/no-bend indication. Such switches and/or control devices have heretofore generally been specifically constructed or configured for a specific function with reduced utility in terms of their application to other functions.

An object of the invention is to provide a sliding switch or control device for a garment having greater functionality than has previously been possible.

According to the invention there is provided a sliding electrical switch having two spaced elongate flexible surfaces; on each surface at least one electrical contact; and slider means slidable along the surfaces and arranged to cause electrical connection between at least one electrical contact on each surface whereby a plurality of different electrical output signals can be provided. In the foregoing and following sections, the term "switch" shall be taken to refer to both circuit make/break type controls and to circuit parameter variable controls (such as potentiometers, variable capacitors) unless the context clearly indicates that one or other type only is meant.

Usually the flexible surfaces will comprise a textile fabric or other material, such as leather, used for garment manufacture.

In one arrangement each surface carries a plurality of longitudinally spaced electrical contacts, and the slider means is configured so as to cause electrical connection between at least one contact on each surface at selectable positions, whereby a plurality of discrete electrical output signals can be provided. In an alternative arrangement each surface carries an elongate electrical contact, and the slider means provides an electrical connection between the elongate electrical contacts, the resistance or other property of the switch varying in accordance with the position of the slider, whereby a continuously variable electrical output signal can be provided.

Also according to the invention there is provided a garment incorporating a switch as set out above, and incorporating electrically-powered equipment controllable by the position of the slider on the switch.

Embodiments of the invention will now be described by way of example with reference to the accompanying drawings in which:-

Figure 1:
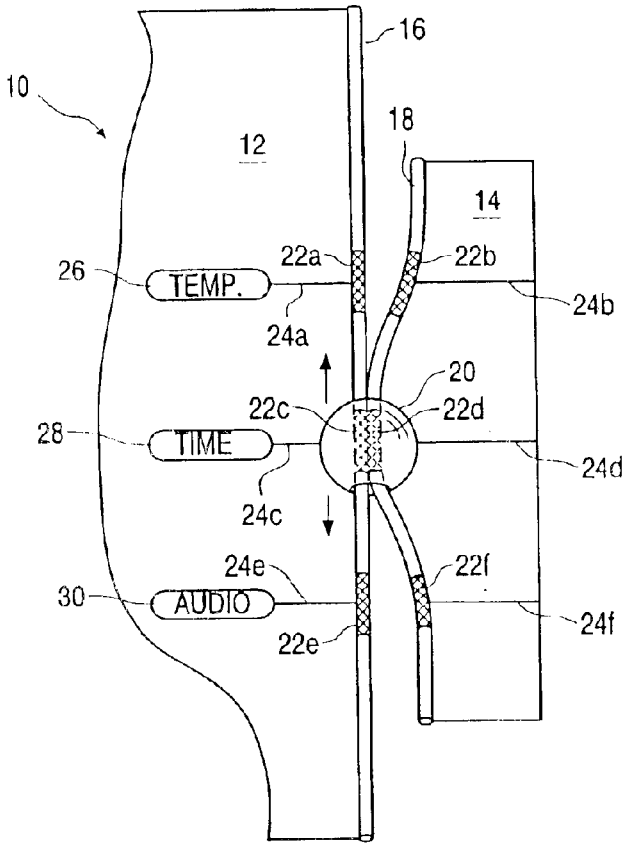
FIG. 1 illustrates a first configuration of control device embodying the present invention and in the form of a selector switch.

In FIG. 1, a selector switch 10 comprises a relatively larger area of fabric 12 and a relatively smaller area of stretchable fabric 14. The areas of fabric have on adjacent edges a cord 16, 18 (or a double or triple hem giving a substantial thickness of fabric). A non-conductive toggle or bead 20 has a partially closed aperture shaped to accommodate both cords, with a longitudinal opening to accommodate the fabric area attachments to the cord: preferably the relative sizes of cord and aperture are such that a cord cannot easily be pulled out of the toggle through the longitudinal opening. As the bead 20 is slid along the cords, it stretches the stretchable fabric 14 so that parts of the two cords within the bead are in physical contact, while elsewhere the stretchable fabric is unstretched and the cords are separated by a small gap.

On the cord 16, 18 above the bead 20 are two lengths 22*a*, 22*b*, shown shaded, covered by a conductive ink. The length 22*a* is connected by a track 24*a* of conductive ink on the fabric's surface to a temperature-sensing circuit 26 and the length 22*b* is connected by a track 24*b* of conductive ink to a power source (not shown).

Below the bead, lengths 22*e*, 22*f* are similarly covered by conductive ink; a conductive track 24*e* connects length 22*e* to an audio circuit 30, and track 24*f* connects length 22*f* to a power source (not shown) which may suitably be the same power source as for circuit 26.

Within the bead 20 lengths 22*c*, 22*d* covered with conductive ink are in electrical contact; the length 22*c* is connected by a track 24*c* to a time-indicator circuit 28 and length 22*d* is connected by a track 24*d* to the power source. Since the lengths 22*c*, 22*d* are in contact, there is a complete electrical circuit and the time indicator 28 is operative.

If the bead 20 is moved up or down the cords, as shown by the arrows, power is disconnected from the time-indicator 28, and when the bead is suitably positioned, either the temperature-sensing circuit 26 or the audio circuit 30 is brought into operation.

Figure 2:
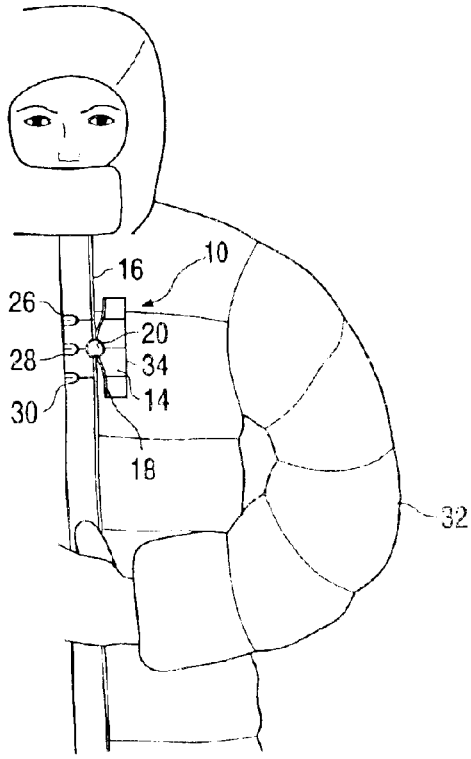
FIG. 2 illustrates the embodiment of FIG. 1 in use on the front of a garment.

In FIG. 2, the switch 10 is shown attached to the front of a cold-weather garment 32. The larger area of fabric 12 is integral with the garment, while the smaller area 14 is stitched to the garment along its edge 34 opposite to the cord 18 at such a distance from the cord 16 that the bead 20 can pull the cords 16, 18 into contact, but the stretchable fabric keeps the cords separate along their lengths outside the bead.

Thus simple movement of the bead 20 up and down the cords allows one of the functions to be selected. The conductive ink areas 22 are easily visible, so selection can be made on a visual basis. The bead 20 can be sufficiently large for selection to be made with a gloved or mittened hand.

The power source (not illustrated) can be positioned in a pocket inside the garment 32. In addition, the circuits 26, 28, 30 can also be positioned in pockets inside the garment, with only visual indicators of the function on the outside of the garment, to assist the wearer in function selection.

Figure 3:
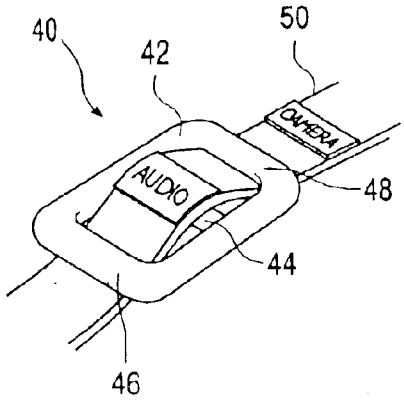
FIG. 3 illustrates a second embodiment of control device embodying the present invention and configured as a selector switch.
Figure 4:
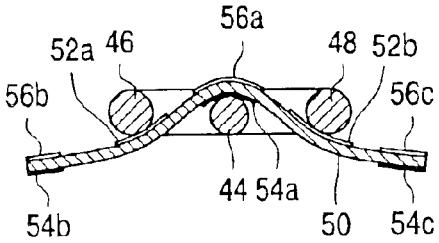
FIG. 4 is a cross-section through the selector switch of FIG. 3.

In FIGS. 3 and 4, a second example of a selector switch 40 has the form of a buckle 42 of conducting material having a central bar 44 and end bars 46, 48. A strip 50 is threaded through the buckle. The strip 50 is of insulating material such as leather, and carries on its upper and lower surfaces conductive areas in alternation and spaced to match the dimensions of the buckle 42.

Referring to FIG. 4, conductive areas 52*a, b* on the upper surface of the strip 50 are spaced along the strip so that they can simultaneously make electrical contact with the end bars 46, 48 of the buckle. A conductive area 54*a* on the lower surface of the strip 50 is spaced to make contact with the central bar 44 of the buckle. On the upper surface of the strip 50 in register with the area 54*a* there is a label 56*a*, indicating a function associated with the conductive area 54*a*.

Other conductive areas 54*b*, 54*c* on the lower surface have corresponding function labels 56*b*, 56*c* on the upper surface of the strip.

With the relative positions of the strip 50 and buckle 42 as shown in FIG. 4, the function indicated on label 56*a* and associated with the conductive area 54*a* is selected. An electrical connection is made through the buckle 42 to a circuit (not shown) providing the indicated function and to a power source (not shown).

Referring again to FIG. 3, by sliding the buckle 42 along the strip 50 different functions, such as an audio circuit, a camera circuit etc., can be selected.

Figure 5:
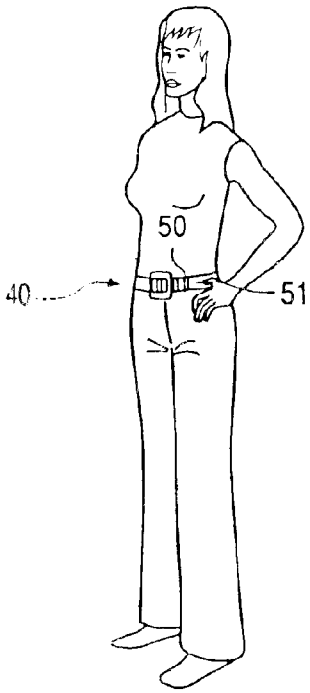
FIGS. 5 and 6 represent examples of use of the selector switch of FIG. 3.
Figure 6:
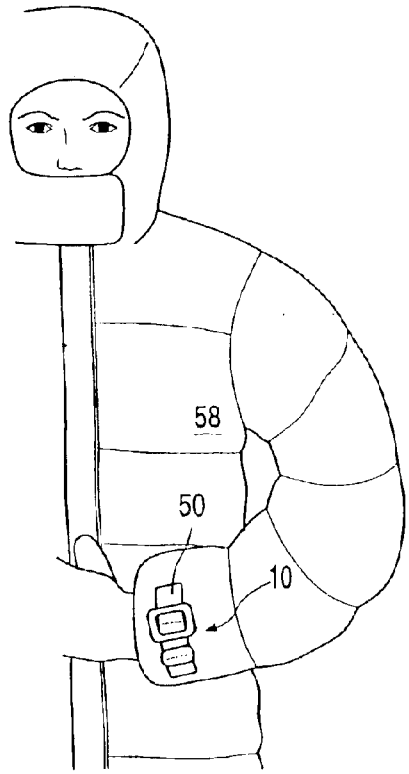

FIG. 5 shows one application of a selector switch 40 in which the strip 50 is provided as part of a waist belt 51. FIG. 6 shows another application of a selector switch 40, in which the strip 50 is provided as a short strap on the sleeve of a cold-weather garment 58. In either application, the user slides the buckle along the strip to select the required function.

Figure 7:
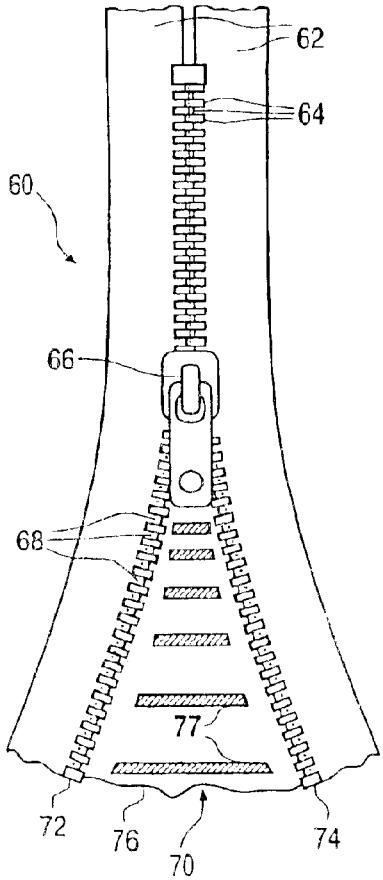
FIG. 7 illustrates a third configuration of control device embodying the present invention and in the form of a continuously variable switch.

In FIG. 7, a continuously variable switch 60 is in the form of a modified zip fastener comprising two strips of fabric 62 having on opposed edges thereof arrays of metal teeth 64 which are caused to interlock or unlock by movement of a metal traveller or slider 66. The modified zip fastener has on the underside of the fabric electrical connections 68 between adjacent teeth 64. For example a conductive thread may be used, or conductive ink. At the open end 70 of the zip, the connections 68 have contacts 72, 74 by which electrical connection can be made. The electrical path runs from contact 72 or 74 along the teeth 64 and connections 68 between the teeth to the traveller 66, which provides an electrical contact between one set of teeth and the other.

Moving the traveller 66 up and down causes an increase or decrease in the electrical path and therefore a change in resistance, i.e. the modified zip fastener acts as a potentiometer. The switch 60 can be used to control e.g., the volume of an audio system built into a garment. In such an application, on the backing fabric 76 of the zip, it is possible to print graphics 77, indicating the function e.g. increase in volume.

Figure 8:
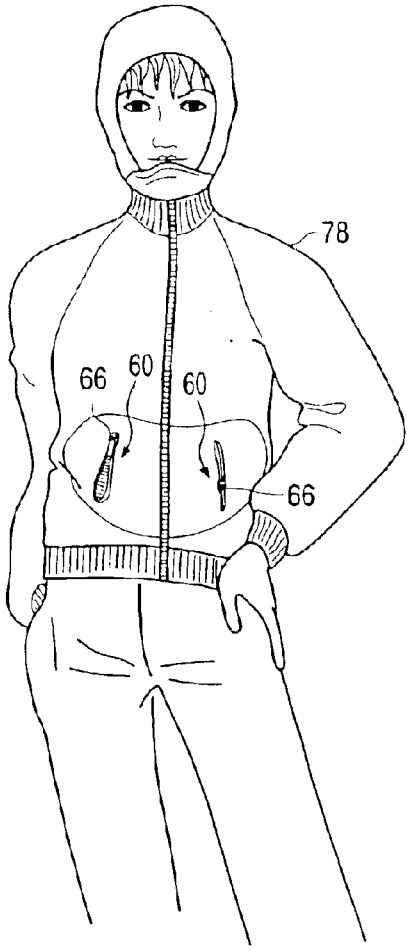
FIG. 8 illustrates the embodiment of FIG. 7 in use on a garment.

FIG. 8 shows the embodiment in use. A cold weather garment 78 is provided, at a position within easy reach of the wearer, with two continuously variable switches 60, each having a traveller 66. The electrical circuitry controllable by the switches and the power sources (not shown) can be provided in pockets on the inside of the garment 78.

Figure 9:
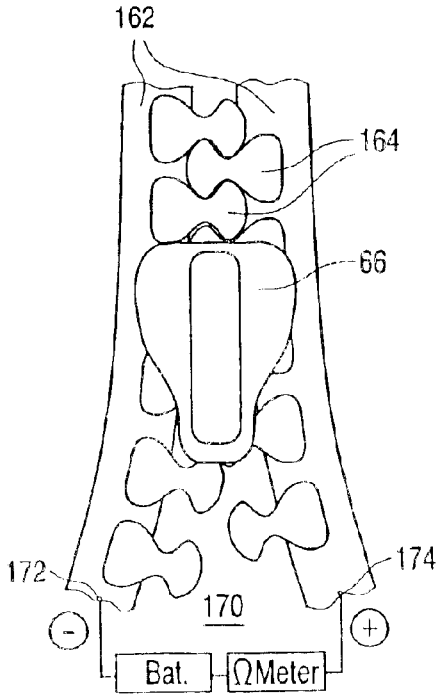
FIG. 9 illustrates a modification to the continuously variable switch embodiment of FIG. 7.
Figure 10:
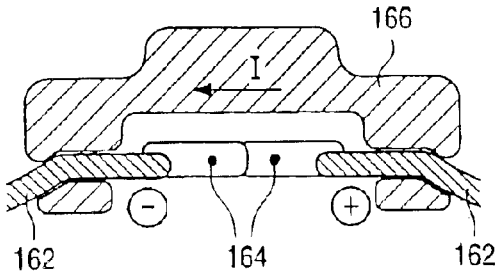
FIG. 10 is a cross-section through the zipper slider of FIG. 9.

A further modified zip fastener arrangement is shown in FIGS. 9 and 10, this time comprising two strips of conductive fabric 162 (or fabric carrying a conductive track) having on opposed edges thereof arrays of teeth 164 of plastic or other insulating material, which teeth are caused to interlock or unlock in conventional by movement of a metal traveller or slider 166 which is of sufficient width to contact the conductive strips 162.

As for the FIG. 7 embodiment, at the open end 170 of the zip, contacts 172, 174 are provided by which electrical connection can be made, although this time it is electrical contact to the conductive strips 162. As shown, the electrical path runs from contact 172 or 174 along the strips 162 to the traveller 166, which provides an electrical contact between one conductive strip and the other. Moving the traveller 166 up and down causes an increase or decrease in the electrical path and therefore a change in resistance.

FIG. 10 is a schematic elevation through the traveller 166 (omitting the teeth interlock mechanism) showing how the insulated teeth 164 keep the strips 162 of conductive fabric apart, until bridged by the slider or traveller 166. The direction of flow of current I is also shown.

Figure 11:
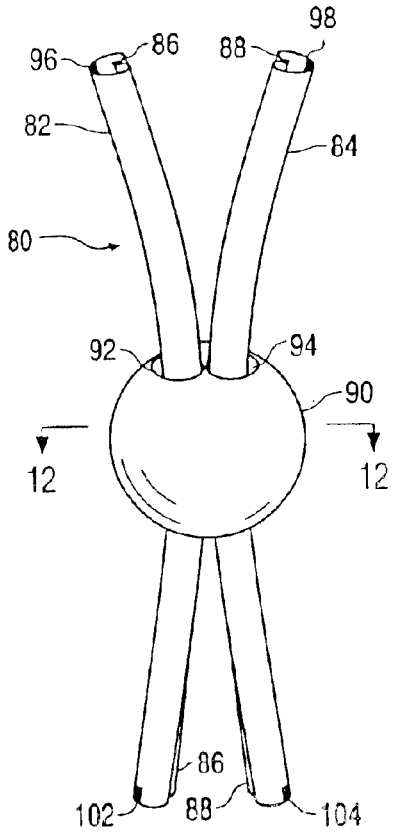
FIG. 11 illustrates a fourth configuration of control device embodying the present invention and in the form of a continuously variable switch.

In FIG. 11 a further example of a continuously variable switch 80 comprises two lengths of piping 82, 84 of insulating material such as rubber, each having a respective longitudinal slot 86, 88. A bead 90 of insulating or conductive material has two apertures 92, 94 matching the diameters of the piping and allowing the bead to move along the piping. Each length of piping 82, 84 has on its inner surface remote from the slots 86, 88, a longitudinal conductive strip 96, 98.

Figure 12:
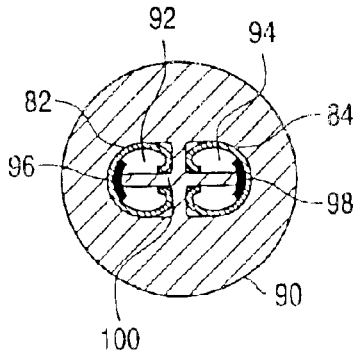
FIG. 12 is a cross-section through the slider in the embodiment of FIG. 11, taken along the line A—A.

The cross-sectional view of FIG. 12 shows that the apertures 92, 94 of the bead 90 are bridged by a bar 100 of conducting material, which forms an electrical contact between the conductive strips 96, 98. This bar 100 may be integral with the bead 90 (as shown) or it may be a separate component when the bead is a body of insulating material. Referring again to FIG. 12, adjacent ends of the piping 82, 84 each have an electrical connector 102, 104. As the bead 90 is moved along the lengths of piping, the length of conductive surfaces 96, 98 between the connectors 102, 104 is varied, so the resistance varies also.

Figure 13:
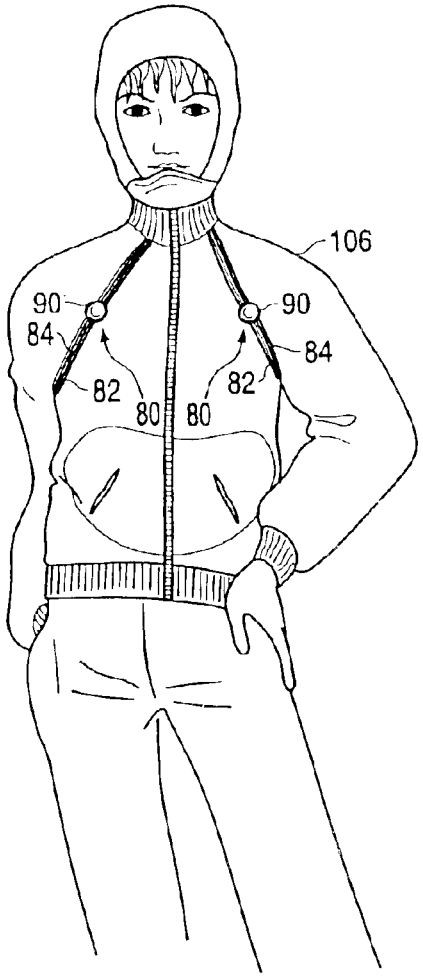
FIG. 13 illustrates the embodiment of FIG. 11 in use on a garment.

FIG. 13 shows the embodiment of FIGS. 11 and 12 in use. A cold weather garment 106 is provided, at a position within easy reach of the wearer, with two continuously variable switches 80, each having a slidable bead traveller 90 mounted on a respective pair of lengths of piping 82, 84. The electrical circuitry controllable by the switches and the power sources (not shown) can be provided in pockets on the inside of the garment 106.

Figure 14:
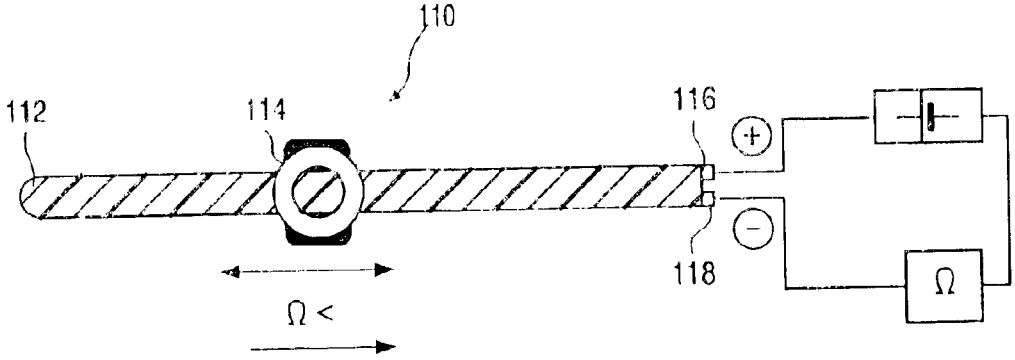
FIG. 14 illustrates a fifth configuration of control device embodying the present invention and in the form of a continuously variable switch.
Figure 15:
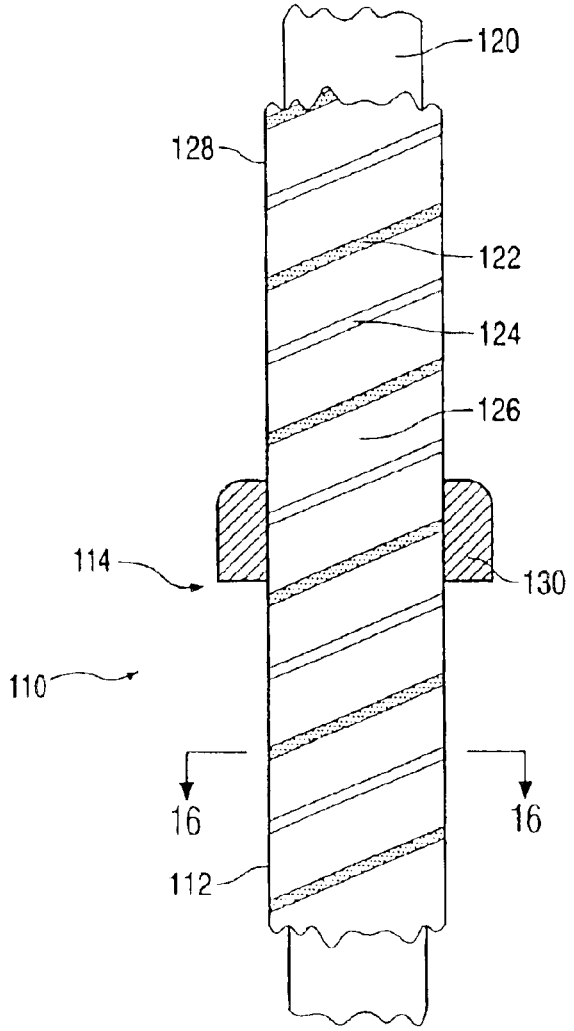
FIG. 15 shows a part of the embodiment of FIG. 14 in greater detail.
Figure 16:
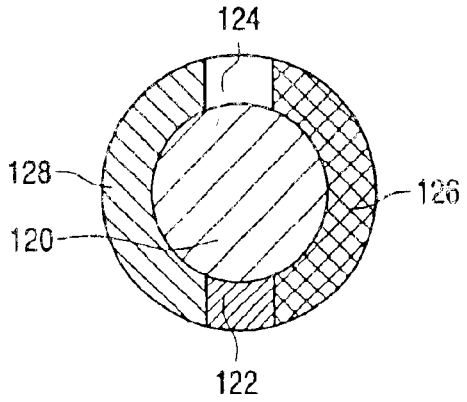
FIG. 16 is a cross-section through the part of FIG. 15, taken along the line B—B.

A still further embodiment of continuously variable switch 110 is shown in FIGS. 14, 15 and 16. As shown in FIG. 14, the switch 110 comprises a generally elongate body 112 of helical construction (described below) with a slider 114 mounted thereupon. At one end, the switch has a pair of contacts 116, 118 for two elongate tracks to be bridged by the slider 114. The general arrangement when in use upon a garment will be with the body 112 mechanically secured to the garment at the end where the contacts 116, 118 lie, with the opposite end either hanging free (suitably with some form of end stop being provided to prevent slider 114 from being pulled off of the body 112) or secured also to the garment in like manner to the lengths of piping 82, 84 (FIG. 13).

The construction of the elongate body 112 is illustrated in greater detail in FIG. 15, which shows a portion of the body in greater detail, and FIG. 16, which shows a sectional view along line B—B from FIG. 15. The elongate body 112 is formed as a core 120 of insulating material about which core are wound in interspersed helical arrangement first 122 and second 124 conductive strips separated by first 126 and second 128 bands of insulating material. The slider 114 includes a collar of conductive material 130 with the helical pitch of the first and second conductors 122, 124 being greater than the thickness of the slider 114 such that it is generally only in contact with a single loop of each conductive body at a time.

From reading the present disclosure, other modifications will be apparent to persons skilled in the art. Such modifications may involve other features which are already known in the design, manufacture and use of sliding electrical switches for garments and applications thereof and which may be used instead of or in addition to features already described herein. For example, the discrete helical paired conductors with interspersed helical insulators of FIGS. 14 to 16 may be replaced by the provision of painted (or otherwise deposited) helical conductive tracks of copper or other such substance deposited on the surface of an elongate body.

What is claimed is:

1. A sliding electrical switch having two spaced elongate flexible tubes of insulating material having longitudinal slots; the inside surface of each tube having at least one elongate electrical contact; and slider means having apertures through which the tubes pass and being slidable along the surfaces and arranged to cause electrical connection between said at least one electrical contact on each surface, the resistance of the switch varying in accordance with the position of the slider means, whereby a continuously variable electrical output signal can be provided.

2. A garment including a switch according to claim 1, and electrically powered equipment controllable by the position of the slider on the switch.

3. A garment according to claim 2, in which there is a single item of electrically powered equipment, the intensity of the output of the equipment being controllable by the position of the slider of the switch.

* * * * *